United States Patent [19]

Swietzer

[11] 4,273,820

[45] Jun. 16, 1981

[54] EMBOSSED SHEET TYPE COVERING MATERIAL

[75] Inventor: William F. Swietzer, Danielsville, Pa.

[73] Assignee: GAF Corporation, New York, N.Y.

[21] Appl. No.: 711,813

[22] Filed: Aug. 5, 1976

[51] Int. Cl.[3] ..... B32B 3/30; B32B 31/26

[52] U.S. Cl. ..... 428/159; 264/230; 264/321; 427/276; 427/373; 156/78; 156/79; 156/220; 428/160

[58] Field of Search ..... 428/159, 160; 264/45.1, 264/51, 230, 129, 132, 134, 135, 136, 137; 156/77-79, 219-221; 427/276, 373, 275, 264, 270, 278; 101/32

[56] References Cited

U.S. PATENT DOCUMENTS

| | | | |
|---|---|---|---|
| 3,342,922 | 9/1967 | Karpovich et al. | 264/321 |
| 3,752,690 | 8/1973 | Miller | 427/278 |
| 3,914,485 | 10/1975 | Curtis | 428/159 |
| 3,953,639 | 4/1976 | Lewicki, Jr. | 428/159 |

FOREIGN PATENT DOCUMENTS

| | | | |
|---|---|---|---|
| 1247616 | 9/1971 | United Kingdom | 427/275 |

*Primary Examiner*—Stanley S. Silverman
*Attorney, Agent, or Firm*—James Magee, Jr.; Joshua J. Ward

[57] ABSTRACT

Decorative sheet type material and process for making same. The material comprises a substrate, an embossed foamed plastic layer, a translucent layer having raised portions corresponding to embossed portions of the embossed layer and preferably a wear layer. The process involves forming an embossed foamed plastic layer on a substrate, covering the embossed layer with a layer of heat curable translucent plastic and then heating the materials sufficiently to cure the translucent plastic and also to allow embossed portions of the embossed layer to partially expand to create raised portions of the translucent layer corresponding to embossed areas of the embossed layer.

17 Claims, 2 Drawing Figures

EMBOSSED SHEET TYPE COVERING MATERIAL

BACKGROUND OF THE INVENTION

This invention relates to a decorative sheet type covering material and to a method for preparing such material.

Decorative sheet type covering materials such as vinyl floor coverings are well known and various attempts have previously been made to impart various three dimensional characteristics to the surface of such materials. U.S. Pat. No. 3,458,337 to Rugg suggests a method for producing a textured surface by employing a resin layer containing a catalyst activated foaming agent and then applying in selected pattern areas an agent for suppressing the catalytic action of the catalyst. U.S. Pat. No. 3,293,094 to Nairn et al also makes use of a chemical inhibitor to control the extent of foaming which takes place on various portions of the material. Mechanical embossing has also been used to obtain three dimensional effects. For instance, U.S. Pat. No. 3,345,234 to Jecker et al describes a process for mechanically embossing a sheet of resinous composition, coating the embossed sheet with an additional resin composition to fill in the embossed areas and then laminating a backing sheet to the structure. U.S. Pat. Nos. 3,741,851 to Erb et al and 3,887,678 to Lewicki are also typical of the extensive prior art relating to mechanical embossing of sheet type covering materials. Mechanically foamed plastic layers are also known and include those described in U.S. Pat. No. 3,511,788 to Keel. The disclosure of all of the above mentioned patents are incorporated herein by reference.

SUMMARY OF THE INVENTION

It is accordingly an object of the invention to provide decorative sheet type covering material such as sheet vinyl floor covering product having a unique textured appearance.

In accordance with the invention a decorative sheet type covering material is provided which comprises a substrate, an embossed foamed plastic layer adhered to the substrate and a heat cured translucent plastic layer adhered to the embossed layer. The translucent layer has raised portions corresponding to the embossed portions of the embossed layer. A wear layer of polyurethane or cured polyvinyl chloride (PVC) plastisol or organosol is preferably adhered to the translucent layer.

The process of the invention comprises forming an embossed foamed plastic layer on a substrate, covering the embossed layer with a layer of heat curable translucent plastic and then heating the translucent plastic layer and embossed layer sufficiently to cure the translucent plastic and to allow embossed areas of the embossed layer to partially expand so as to form raised portions of the translucent layer corresponding to the embossed portions of the embossed layer. In a preferred embodiment the translucent layer is jelled and a clear wear layer of polyurethane or PVC plastisol or organosol is applied followed by sufficient heating to cure both the translucent layer and the wear layer.

BRIEF DESCRIPTION OF THE DRAWINGS

FIG. 1 illustrates the material at an intermediate stage of manufacture, prior to curing of the translucent layer and wear layer. FIG. 2 illustrates the finished product. In these views it is not intended that the thickness of the various layers of the product shown are precisely represented, rather the various layers are represented on a considerably enlarged scale and without showing precise relationships between thickness of the layers.

DETAILED DESCRIPTION OF THE INVENTION

Figure 1:
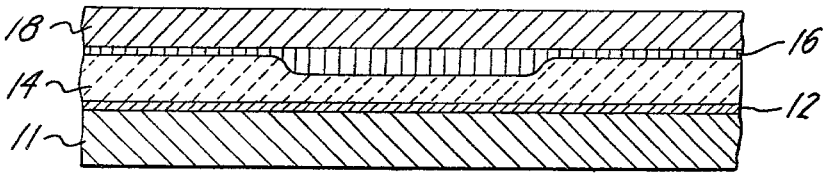
FIGS. 1 and 2 are fragmentary sectional views through a preferred floor covering material of the invention.

As mentioned above, the preferred embodiment of the invention is a decorative sheet type material comprising a substrate, an embossed foamed plastic layer adhered to the substrate, a layer of heat cured translucent plastic adhered to the embossed layer and having raised portions corresponding to the embossed portions of the embossed layer and a clear wear layer adhered to the translucent layer.

The substrate may include any suitable supporting material such as asbestos sheet, non-woven or woven fibrous web, a plastisol layer, plastisol on felt backing, etc. While almost any flexible substrate may be used, the preferred substrate is felt, most advantageously an impregnated asbestos felt or a resin impregnated cellulose or other organic felt or, with suitable sealing coats, an asphalt saturated organic felt. While felt is preferred, paper, sheet cloth, or even metal foil may be used for some purposes such as wall coverings.

The use of a sealing or priming coat on the substrate is not considered essential but is preferred, especially where a felt base is used. Where used, the sealing or priming coat may be made up of a latex, for example a latex containing an acrylic polymer with or without pigment fillers such as the prime coat described in U.S. Pat. No. 3,458,337 to Rugg.

The embossed foamed plastic layer may be formed of any suitable materials such as latex, polyurethane, vinyl plastics etc., and may be either chemically or mechanically foamed and embossed in any conventional manner. Mechanically foamed plastisols are well known and include those described in U.S. Pat. No. 3,511,788. Chemically foamed plastics are equally well known and include those described in the above mentioned U.S. Pat. No. 3,458,337. For preferred embodiments of the invention the foamed plastic layer comprises vinyl plastic, especially cured PVC plastisol or organosol. The foamed plastic layer may be embossed in any suitable manner such as in accordance with the teachings of the above U.S. patents. While chemically embossed foamed plastic may be used, mechanically embossed foamed plastic is strongly preferred. The raised portion of the translucent layer are generally more pronounced when mechanically embossed foamed plastic is used. For best visual effects in the finished product, embossed areas are preferably sufficiently deep so that the finished product has embossed areas between about 2 and about 50 mils deep. While it will be appreciated that density of the embossed layer may vary widely, densities of the unembossed foamed layer frequently range between 0.8 and about 0.25 g/cm$^3$.

For most applications, especially for use as flooring, the products of the invention should include a cured wear layer over the translucent pigmented layer. To provide necessary protection on flooring material a vinyl plastic wear layer should have a minimum thickness of about 4 mils, preferably about 7 mils, and depending upon the degree of protection desired may be substantially thicker, such as up to about 15 or 20 mils or more. Polyurethane wear layers may be thinner, such as between about 1 and about 5 mils thick. The wear layer is not however considered an essential element of the invention since the translucent layer, especially if it is sufficiently thick and of a material suitable for a wear layer, may serve both purposes. Where used the wear layer may comprise any suitable conventional material, preferably polyurethane or a vinyl plastic such as cured PVC plastisol or organosol. Such materials are well known in the art and include those described in the above mentioned U.S. Pat. No. 3,458,337.

The heat cured translucent plastic layer which is an essential element of the invention may comprise any suitable material such as latex, polyurethane, vinyl resin, etc., but preferably comprises a polyurethane or a vinyl plastic such as a cured PVC plastisol or organosol of the type discussed above with respect to wear layers. While the translucent layer may be present in any suitable thickness. it is preferred that this layer have a minimum thickness of about 2 mils. Preferred thicknesses at various points may vary from a minimum of about 2 mils over unembossed portions of the foamed embossed layer to a maximum of 50 mils or more over the embossed portions of the embossed layer. Preferably the raised portions of the translucent layer corresponding to the embossed portions of the embossed layer extend between about 2 and about 25 mils above the remaining portions of the translucent layer.

The translucent layer may be pigmented in any suitable manner, preferably by mixing pigment with the plastic used to form the translucent layer, it being understood that the degree of pigmentation may vary widely from clear to diffused and from very light tint to significantly darker tint as desired. The translucent layer may also be uncolored, in which case it is preferred that the embossed portion of the embossed layer be at least partially colored by suitable means such as valley printing. Additionally, conventional chips such as the gelled or fused plasticized vinyl chips frequently used in flooring materials may be included within the translucent layer for additional decorative effect. Additional conventional decorative effects may also be used.

As mentioned above, the basic process of the invention involves the manufacture of a decorative sheet type covering material by first forming an embossed plastic layer on a substrate, covering the embossed layer with a layer of heat curable translucent plastic and then heating the translucent plastic sufficiently to cure same and to allow embossed areas of the embossed layer to partially expand so as to form raised portions of the layer of translucent plastic corresponding to the embossed portions of the embossed layer. In the case of mechanically embossed foamed plastic, the partial expansion of the embossed portions occurs because these portions are considerably compressed during embossing. The heat applied during the curing step serves to soften the compressed, foamed plastic sufficiently to allow partial (but only partial) reexpansion of the compressed foam to its uncompressed density and thereby force the as yet incompletely cured translucent layer upwardly to form raised portions of the translucent layer over the embossed portions of the embossed layer. In the case of chemically embossed foamed plastic, the partial expansion of the embossed areas represents additional expansion of the plastic foam beyond that obtained during initial expansion of the foam. This occurs despite the presence of suppressant ink used in chemical embossing and, like reexpansion of mechanically embossed areas, results in raised portions of the translucent layer corresponding to embossed areas of the embossed layer. In general, such raised portions are less pronounced when chemically foamed embossed layers are used and the use of mechanically foamed layers is, therefore, usually preferred.

As mentioned above, preferred embodiments of the invention involve the use of a separate clear wear layer over the translucent layer. Where such a wear layer is used, the translucent layer is normally gelled and the wear layer applied before the entire sheet is heated to a temperature sufficient to cure (e.g. fuse PVC plastisol or organosol) both the translucent layer and the wear layer.

Materials suitable for use in practicing the process of the invention include those described above in connection with the preferred embodiments of the product of the invention. In order to obtain the appropriate thicknesses of the various layers going to make up the product, the materials may be spread in the proper order in any suitable conventional manner such as by the use of knife coaters or, where appropriate, reverse roll coaters. For preferred embodiments of the products using the preferred material described above, the embossed foamed layer may originally be applied in the unfoamed condition in thicknesses typically between about 5 and about 20 mils while the translucent layer is normally applied in thicknesses between about 2 and about 20 mils with respect to the unembossed portions of the embossed layer. Considerably greater thicknesses of translucent layer are, of course, obtained in the embossed portions of the embossed layer. Likewise the wear layer, where used, may frequently be applied to the gelled translucent layer in thicknesses between about 4 and about 20 mils or greater.

Figure 2:
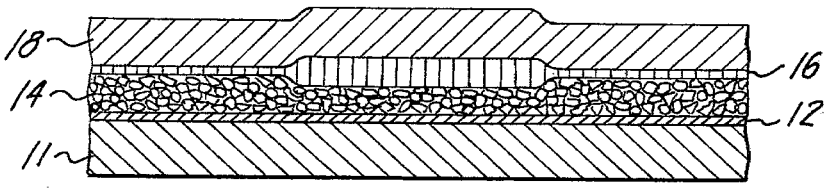

For a further appreciation of the unique structure and advantages of the products of the invention reference may be had to the drawings. FIG. 1 illustrates a partially completed product of the invention in which the pigmented translucent layer has been applied to the embossed foamed layer and gelled and in which the wear layer has been applied but in which the wear layer and translucent layer have not been cured. FIG. 2 represents the same product after heating to a sufficient temperature to cure the wear layer and translucent layer and to allow partial expansion of the embossed portions of the embossed layer to thereby create raised portions of the translucent layer corresponding to such embossed areas. In the drawings it can be seen that the product comprises a substrate 11 having a priming or sealing coat 12, an embossed foamed layer 14, a pigmented translucent layer 16 and a wear layer 18.

It will be appreciated that temperatures required to cure the translucent layer of the invention and to allow partial expansion of the embossed portions of the embossed layer may vary widely depending upon the particular materials and curing times used, however, curing times of between about 1 and about 5 minutes at between about 325° and about 500° F. are frequently suitable in conjunction with preferred thicknesses of the preferred materials described above. Conditions suitable for gelling the translucent layer without curing same for use in conjunction with preferred materials of the invention where a wear layer is to be subsequently applied prior to curing included gelling temperatures between about 150° and about 300° F. for a time between about 1 and about 5 minutes. It should be understood of course that the relatively shorter times mentioned are generally used where relatively higher temperatures are employed and conversely that at relatively lower temperatures, relatively longer times are employed.

EXAMPLE

This example illustrates a suitable method for preparing a product such as that depicted in FIG. 2. In making this particular product a 28 mil asbestos sheet was coated with latex seal coat to provide improved vinyl adhesion and impermeability of plasticizers. The seal coat was an acrylic water emulsion of approximately 25% wt. solids consisting of 35–40% ethyl acrylate and 60–65% methyl methacrylate. A 12 mil thick foamable base coat containing a catalyst and blowing agent for expansion was applied to the seal coated asbestos felt and foamed in a two zone tunnel oven at 370°–350° F. with a 2.75 minute cure cycle. The base coat composition was as follows:

| | Parts |
|---|---|
| PVC homopolymer dispersion resin | 50 |
| PVC homopolymer suspension resin | 50 |
| 2,2,4 trimethyl pentanediol isobutyrate benzoate | 56 |
| Epoxidized soya oil | 6 |
| Zinc-Cadmium catalyst | 2.5 |
| Azodicarbonamide | 2.5 |
| Titanium dioxide | 7.5 |

Upon exit from the oven, the hot foamed sheet was embossed with a random patterned textured metal roll pressing on the sheet as it passed over a hard rubber roll.

A lightly pigmented vinyl translucent coating filled with gold pearlescent dust and gold and silver flecks was applied to the embossed foamed sheet by means of a knife coater and gelled on a hot chrome roll at 300° F. The pigmented translucent coating had a composition exclusive of pigment and gold and silver fillers as follows:

| | Parts |
|---|---|
| PVC homopolymer dispersion resin | 54 |
| PVC homopolymer suspension resin | 46 |
| 2,2,4 trimethyl pentanediol isobutyrate benzoate | 32 |
| Light stabilizer | 32 |
| Epoxidized soya oil | 6 |
| Mineral spirits | 3 |

The above coating procedure was carried out so as to obtain a thickness of 3 mils over the unembossed areas of the embossed foamed layer. Due to the depth of the embossing this resulted in up to about 20 mils thickness in the embossed areas.

An 8 mil wear layer was then applied over the gelled translucent coating with a knife coater and the entire sheet received a 2.75 minute heat cure at 355° F. The heat cure resulted in partial expansion of embossed areas of the embossed layer, resulting in raised portions of the translucent layer and wear layer. In this particular example raised portions of the translucent area extended up to 10 mils above the portions of the translucent layer over the unembossed areas of the embossed layer. The wear layer formula used was as follows:

| | Parts |
|---|---|
| PVC homopolymer dispersion resin | 100 |

-continued

| | Parts |
|---|---|
| 2,2,4 trimethyl pentanediol isobutyrate benzoate | 56 |
| Light stabilizer | 5 |
| Epoxidized soya oil | 6 |
| Mineral spirits | 3 |
| Alkylphenylether of polyethylene glycol | 6 |

While the invention has been described with respect to preferred embodiments thereof, it will be understood by those skilled in the art that various changes and modifications may be made without departing from the spirit or scope of the invention.

What is claimed is:

1. A process for making decorative sheet type covering material comprising the steps of:

(a) forming an embossed foamed plastic layer adhered to a substrate;

(b) subsequently covering said embossed layer with a layer of heat curable, translucent plastic; and (c) heating the material sufficiently to cure said layer of translucent plastic and to allow embossed portions of the embossed layer to partially expand to form raised portions in the layer of translucent plastic corresponding to embossed portions of the embossed layer.

2. A process according to claim 1 in which the embossed foamed layer is mechanically embossed.

3. A process according to claim 1 in which the translucent layer is pigmented.

4. A process according to claim 1 in which, prior to step (c) of claim 1, the translucent layer is gelled and a clear wear layer is applied over the translucent layer, said wear layer comprising a layer of polyurethane or a layer of PVC plastisol or organosol and said wear layer being cured during step (c).

5. A process according to claim 1 in which, the foamed layer and the translucent layer each comprises polyurethane or vinyl resin.

6. A process according to claim 1 in which, the substrate comprises felt coated with latex.

7. A process according to claim 1 in which, the translucent layer has a thickness ranging from a minimum of at least about 2 mils to a maximum of about 50 mils.

8. A process according to claim 1 in which the unembossed portions of the foamed layer have a density between about 0.25 and about 0.8 g/cm$^3$ and the embossed areas thereof form depressions in the finished products at least about 2 mils deep.

9. Decorative sheet type covering material produced by the process of claim 1.

10. Decorative sheet type covering material comprising:

(a) a substrate;

(b) an embossed, foamed plastic layer adhered to said substrate; and (c) a translucent, heat cured plastic layer adhered to said embossed layer and having raised portions corresponding to embossed portions of the embossed layer.

11. Material according to claim 10 in which the embossed layer is mechanically embossed.

12. Material according to claim 10 in which the translucent layer is pigmented.

13. Material according to claim 10 in which the foamed plastic layer and the translucent layer each comprise polyurethane or vinyl resin.

14. Material according to claim 13 and also including a wear layer adhered to the translucent layer, said wear layer comprising polyurethane or PVC plastisol or organosol.

15. Material according to claim 10 in which the translucent layer comprises pigmented polyurethane or pigmented PVC plastisol or organosol.

16. Material according to claim 10 in which the density of the unembossed portions of the embossed layer is between about 0.25 and about 0.8 g/cm$^3$.

17. Material according to claim 10 in which the depressions formed by the embossed portions of the embossed layer are between about 2 and about 25 mils deep and the raised portions of the translucent layer extends between about 2 and about 25 mils above the remainder of the translucent layer with the translucent layer having a minimum height above such unembossed portions of about 2 mils.

* * * * *